United States Patent [19]

Scott

[11] Patent Number: 4,815,530

[45] Date of Patent: Mar. 28, 1989

[54] KOOL KAP

[75] Inventor: John Scott, Oldsmar, Fla.

[73] Assignee: Kool Kap Corp., Fla.

[21] Appl. No.: 24,261

[22] Filed: Mar. 10, 1987

[51] Int. Cl.[4] ..... F28F 19/00

[52] U.S. Cl. ..... 165/134.1; 98/116; 62/507

[58] Field of Search ..... 165/134.1; 98/116; 62/507

[56] References Cited

U.S. PATENT DOCUMENTS

| | | | |
|---|---|---|---|
| 2,750,868 | 6/1956 | Mieczkowski et al. | 98/116 |
| 2,985,447 | 5/1961 | Braskamp | 98/116 X |
| 3,194,146 | 7/1965 | Jenson | 98/116 X |
| 3,396,652 | 8/1968 | Morrison et al. | 98/116 X |
| 3,479,947 | 11/1969 | Myers | 98/116 |
| 3,826,183 | 7/1974 | Rudine | 98/116 |
| 4,047,475 | 9/1977 | Cox | 98/116 |
| 4,200,117 | 4/1980 | Anderson et al. | 98/116 X |
| 4,228,663 | 10/1980 | Picarello | 62/507 |
| 4,340,115 | 6/1982 | Wright et al. | 165/134.1 X |
| 4,475,585 | 10/1984 | Hoeffken | 165/134.1 |

*Primary Examiner*—Ira S. Lazarus
*Assistant Examiner*—Richard R. Cole
*Attorney, Agent, or Firm*—Frijouf, Rust & Pyle

[57] ABSTRACT

An air conditioning unit with a protective cap for preventing the intrusion of sun, rain, snow, debris, and the like, into an updraft fan housing and an area proximate heat exchange coils is disclosed. The cap comprises a cap member and a hinge member having a first and second a side. A shoulder member enables a secure attachment of the cap member to the second side of the hinge member. The second side of the hinge member is securely attached to the shoulder member to enable the cap member to pivot relative the first side of the hinge member. The first side of the hinge member is securely attached to the air conditioning unit proximate the exhaust opening of the air conditioning unit to enable the cap member to pivot open upon activation of the updraft fan moving ambient air out of the exhaust opening and to pivot to a closed position upon deactivation of the updraft fan causing the movement of the ambient air to stop. The cap prevents the intrusion of the debris, rain, snow and sun into the exhaust opening of the air conditioning unit during the deactivation of the updraft fan and deflects sound generated by the updraft fan during the activation of the updraft fan.

22 Claims, 2 Drawing Sheets

KOOL KAP

BACKGROUND OF THE INVENTION

1. Description of the Invention

This invention relates to an air conditioning unit with a protective cover and more particularly to a protective cover for preventing the intrusion of sun, rain, snow, debris, and the like, into an updraft fan housing of such units.

2. Information Disclosure Statement

Air conditioning units many times are positioned in an area which may interfere with the efficient operation of the unit or which may generate an undesirable noise level during operation. Such an area allows the intrusion of debris, rain, snow and/or sun into the housing of the unit and especially into the exhaust opening housing the updraft fan. Units so positioned may be operationally disadvantaged by the intrusion of the above-mentioned material into the exhaust opening. An air conditioning unit positioned in the sun operates less efficiently because of the additional heat load taken up by the exposed heat exchange coils within the exhaust opening. An air conditioning unit positioned under a roof edge which allows rainwater runoff into the exhaust opening, prematurely ages the unit and also promotes the intrusion of debris caught in the rainwater runoff into the opening. Debris which enters the exhaust opening while the air conditioning unit is in a deactivated or "off" mode can impede the heat exchange capacity by interfering with the air flow across the heat exchange coils of the air conditioning unit and may prematurely age the updrift fan motor. The positioning of an operating unit near a bedroom window can be a nuisance even though the window is closed because of the noise level generated.

Typically air conditioning units are without means to prevent intrusion of debris, rain, snow, sun and other elements hostile to the unit or its operation into the exhaust opening and further fail to include a means to attenuate noise generated by the operation of the unit.

Therefore, it is an object of this invention to provide a cap to prevent the intrusion of debris and the like into the exhaust opening of an air conditioning unit.

It is a further object of this invention to provide a cap to shade the air conditioning heat exchange coils from direct sunlight during the deactivation of the updraft fan thereby reducing the heat load on the coils.

It is a further object of this invention to provide a cap which does not interfere with the air flow generated by the updraft fan.

It is a further object of this invention to provide a cap which opens and close simultaneously with the activation and deactivation, respectively, of the updraft fan of the unit.

It is a further object of this invention to provide a cap which will deflect and attenuate the sound generated during the activation of the updraft fan of the air conditioning unit.

It is a further object of this invention to provide a cap which may be easily attached to the surface of the air conditioning unit approximate the exhaust opening to provide a protective cover therefor.

It is a further object of this invention to provide a cap which may be easily removed from the unit.

It is a further object of this invention to provide a cap which protects the exposed surface of the heat exchange coils within the exhaust opening of an air conditioning unit.

It is a further object of this invention to provide a cap which is economical to produce.

It is a further object of this invention to provide a cap which protects the blades and motor of the updraft fan and heat exchange coils from the intrusion of debris and the like.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For purposes of summarizing the invention, the invention comprises a protective cap comprising a protective cap member and an air conditioning unit located outdoors for conditioning the air in a dwelling. The air conditioning unit includes heat exchange coils and an updraft fan with rotatable blades to enhance the heat exchange between ambient air and the heat exchange coils upon rotation of the blades during activation of the updraft fan. The updraft fan moves ambient air over the heat exchange coils and expels the heat exchanged ambient air through an exhaust opening formed in the top of the air conditioning unit. The cap member is configured to cover the exhaust opening of the air conditioning unit. A hinge member with a first and second side connects the cap to the unit. A shoulder member interconnects and enables secure attachment of the cap member to the second side of the hinge member. The second side of the hinge member is securely attached to the shoulder member to enable the cap member to pivot relative the first side of the hinge member. The first side of the hinge member is securely attached to the air conditioning unit proximate the exhaust opening of the air conditioning unit to enable the cap member to cover the exhaust opening thereby preventing the intrusion of debris, snow, rain and sun into the exhaust opening of the air conditioning unit during the deactivation of the updraft fan and further enabling the cap member to pivot relative the first side of the hinge member to an open position upon rotation of the blades of the updraft fan thereby permitting the passage of heat exchanged air out of the exhaust opening and deflecting sound generated by the updraft fan away from the cap member during the activation of the updraft fan.

In a further embodiment of the invention the cap member further includes a dome portion positioned over the area of the exhaust opening to provide a wind cup thereby enhancing the effect of the expelled heat exchanged ambient air upon the cap member when the updraft fan is activated. The wind cup enables the cap member to remain in a substantially stable open position during the activation of the updraft fan.

In a more specific embodiment the dome is stepped to decrease external wind lift on the cap member. This enables the cap member to remain in a substantially stable closed position to enhance the prevention of debris and the like form entering the exhaust opening when the updraft fan is deactivated.

The cap member may be biased in the closed position by a spring means, such as a spring, self closing hinge or the like, upon deactivation of the updraft fan to further enhance the prevention of debris and the like form entering the exhaust opening when the updraft fan is deactivated. This is especially useful if the air conditioner unit is located in a windy area.

In another embodiment of the invention the first side of the hinge member further includes an adhesive coating to adhesively secure the cap to the air conditioning unit.

In another embodiment of the invention the shoulder member further includes a flange for securing the second side of the hinge to the cap member. In a more specific embodiment, the flange defines an inverted V-shaped member having a first and second leg. The inverted V-shaped member is integrally formed on the cap member and the first leg is spaced apart from the second leg a sufficient distance to enable a portion of a connection means securely attaching the second side of the hinge member to the first leg of the inverted V-shaped member to be spatially received between the first and second legs of the cap member.

Preferably, the shoulder member further includes a reinforcing means, such as a boss, to enhance structural rigidity of the cap thereby limiting the twisting or torquing of the cap during the activation of the updraft fan and enhancing the fit of the cap when in the closed position relative the exhaust opening by limiting warping of the cap.

Preferably, the cap includes a flexible cord which in use one end is securely attached to the cap member and the remaining end is securely attached to the air conditioner unit to limit the open angular position of the cap member during the activation of the updraft fan.

In a preferred embodiment, the cap comprises a cap member with an air conditioning unit located outdoors for conditioning the air in a dwelling. The air conditioning unit includes coils for exchanging heat with the ambient air and an updraft fan with rotatable blades to enhance the heat exchange between the ambient air and the heat exchange coils upon rotation of the blades during activation of the updraft fan thereby moving the ambient air over the heat exchange coils and expelling the heat exchanged ambient air through an exhaust opening formed in the air conditioning unit. The cap member is configured to protectively cover the exhaust opening of the air conditioning unit. A hinge member having a first and second side is disclosed. A shoulder member enables secure attachment of the cap member to the second side of the hinge member. The second side of the hinge member is securely attached to the shoulder member to enable the cap member to pivot relative the first side of the hinge member. The shoulder member includes a flange for securing the second side of the hinge to the cap member by a connection means. The flange further defines an inverted V-shaped member having a first and second leg. The first leg of the "V" shaped member is spaced apart from the second leg to enable a portion of a connection means to be spatially received between the first and second legs of the V-shaped member thereby allowing the cap to fully close against the air conditioning unit. The connection means securely attaches the second side of the hinge member to the first leg of the inverted V-shaped member. The shoulder member further includes a reinforcing means to enhance structural rigidity of the cap member thereby limiting torquing or twisting of the cap member during the activation of the updraft fan and enhancing the closure fit of the cap member relative the exhaust opening by limiting warping of the cap member during deactivation of the updraft fan. The cap member further includes a dome portion positioned over the area of the exhaust opening to provide a wind cup. The wind cup enhances the effect of the expelled heat exchanged ambient air upon the cap member when the updraft fan is activated to enable the cap member to remain in a substantially stable open position. The dome is stepped to decrease wind lift on the cap member thereby enabling the cap member to remain in a substantially stable closed position to enhance the prevention of debris and the like form entering the exhaust opening when the updraft fan is deactivated. The first side of the hinge member is securely attached to the air conditioning unit proximate the exhaust opening of the air conditioning unit to enable the cap member to cover the exhaust opening thereby preventing the intrusion of debris, snow, rain and sun into the exhaust opening of the air conditioning unit during the deactivation of the updraft fan and enabling the cap member to pivot relative the first side of the hinge member to an open position upon rotation of the blades of the updraft fan thereby permitting the passage of heat exchanged air out of the exhaust opening and deflecting sound generated by the updraft fan away from the cap member during the activation of the updraft fan.

In a further embodiment the first side of the hinge member further includes an adhesive coating to adhesively secure the cap member to the air conditioning unit.

In a further embodiment the cap member further includes a flexible cord having one end securely attached to the cap member and the remaining end securely attached to the air conditioner unit to limit the open angular position of the cap member during the activation of the updraft fan. This minimizes the chance that the cap will be "wind tossed" by the wind during the operation of the updraft fan.

Preferably, the V-shaped member and the shoulder member are integrally formed on the cap member.

In another embodiment of the invention a cap is disclosed for use with an air conditioning unit with heat exchange coils positioned in an environment having debris, rain, snow or sun. An updraft fan with rotatable blades enhances the heat exchange between ambient air and the heat exchange coils upon rotation of the blades moving the ambient air over the heat exchange coils and exiting the moving ambient air out an exhaust opening. The cap comprises a cap member and a hinge member having a first and second side. A shoulder member enables a secure attachment of the cap member to the second side of the hinge member. The second side of the hinge member is securely attached to the shoulder member to enable the cap member to pivot relative the first side of the hinge member. The first side of the hinge member is securely attached to the air conditioning unit proximate the exhaust opening of the air conditioning unit to enable the cap member to pivot open upon rotation of the blades of the updraft fan moving ambient air out of the exhaust opening and to pivot to a closed position upon deactivation of the rotation of the blades of the updraft fan to thereby prevent the intrusion of the debris, rain, snow and sun into the exhaust opening of the air conditioning unit during the deactivation of the updraft fan and to deflect sound generated by the updraft fan during the activation of the updraft fan.

Preferably, the cap member includes a dome position positioned over the area of the exhaust opening to provide a wind cup thereby enhancing the effect of the air being forced against the cap member to enable the cap member to remain in a substantially stable open position when the updraft fan is activated. The cap may be biased in the closed position by a spring means upon deactivation of the updraft fan, if desired.

The invention may further be embodied in a method of preventing the intrusion of debris, rain, snow and sun into an exhaust opening of an updraft fan of an air conditioning unit during the deactivation of the updraft fan and to deflect sound generated by the updraft fan during the activation of the updraft fan by providing a cap with a cap member with a size sufficient to cover the exhaust opening of the air conditioning unit. The cap includes a hinge member having a first and second side with the second side of the hinge member being securely fastened to the cap member to enable the first side of the hinge member to pivot relative the second side of the hinge member. The prevention of the intrusion of debris, rain, snow and sun into the exhaust opening of an air conditioning unit during the deactivation of the updraft fan and to deflect sound generated by the updraft fan during the activation of the updraft fan is conducted by positioning the cap member on the air conditioning unit to cover the exhaust opening of the air conditioning unit. The first side of the hinge member is attached to the air conditioning unit to enable the cap member to pivot open upon rotation of the blades of the updraft fan moving heat exchanged ambient air out of the exhaust opening and to pivot to a closed position upon deactivation of the rotation of the blades of the updraft fan to thereby cover and prevent the intrusion of debris, rain, snow and sun into the exhaust opening of the air conditioning unit during the deactivation of the updraft fan and to deflect sound generated by the updraft fan during the activation of the updraft fan.

The air conditioner units embrace those units known in the art such as those taught in U.S. Pat. Nos. 4,153,310 and 4,261,418 which are incorporated by reference.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
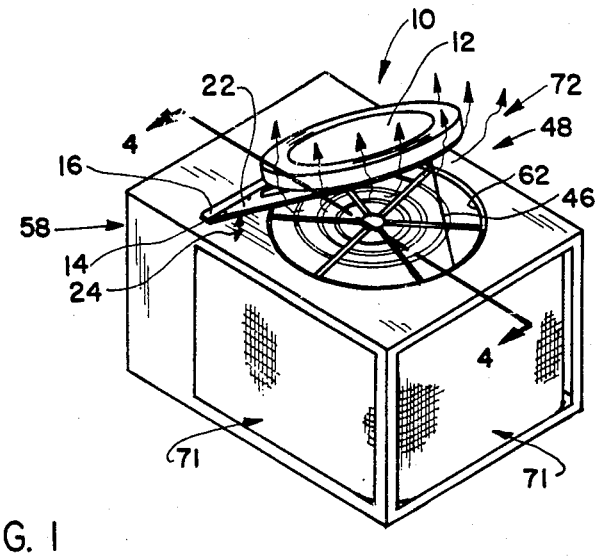
FIG. 1 is an isometric view of an air conditioning unit whereon a protective assembly cover embodying the invention is shown in an open position.

FIG. 1 is an isometric view of the apparatus of the invention 10 positioned to provide a protective cap member 12 to cover the exhaust opening 62 of an air conditioning unit 58. The cap of the invention 10 is securely attached to the air conditioning unit 58 by a hinge member 14 which enables the cap 10 to pivot to the open position 48 upon activation of the updraft fan 64 (not shown) which provides a stream of air which pushes the cap 10 to an open position 48 as illustrated. The venting of the heat exchanged air 72 is schematically illustrated. The cap 10 further includes a flexible cord 46 securely attached to the cap member 12 and the air conditioner unit 58 to limit the open angular position 24 of the cap member 12 during the activation of the updraft fan 64. The hinge member 14 includes a first side 16 and second side 18 (see FIGS. 6–8). The shoulder member 22 of the cap 10 enables a secure attachment of the cap member 12 to the second side 18 of the hinge member 14. The second side 18 of the hinge member 14 is securely attached to the shoulder member 22 to enable the cap member 12 to pivot relative the first side 16 of the hinge member 14. The first side 16 of the hinge member 14 is securely attached to the air conditioning unit 58 proximate the exhaust opening 62 of the air conditioning unit 58 to enable the cap member 12 to cover the exhaust opening 62 thereby preventing the intrusion of debris, snow, rain and sun into the exhaust opening 62 of the air conditioning unit 58 during the deactivation of the updraft fan 64 and enabling the cap member 12 to pivot relative the first side 16 of the hinge member 14 to an open position 48 upon rotation of the blades 66 of the updraft fan 64 thereby permitting the passage of heat exchanged air out 72 of the exhaust opening 62 and deflecting sound generated 74 (FIG. 4) by the updraft fan 64 away from the cap 10 during the activation of the updraft fan 64.

Figure 2:
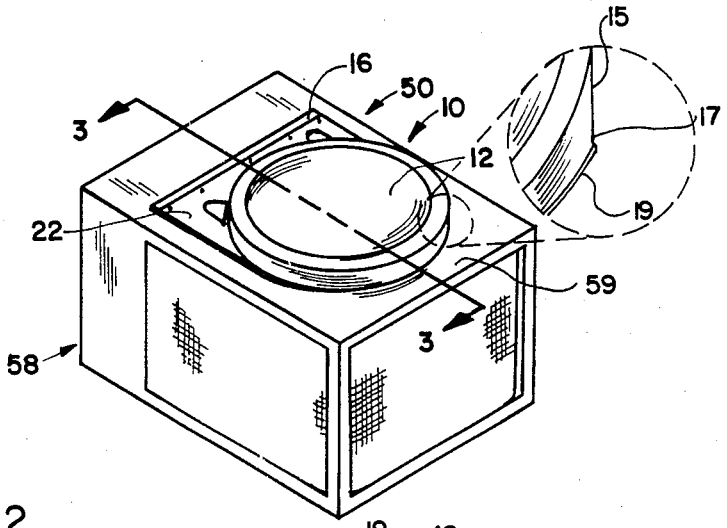
FIG. 2 is an isometric view of an air conditioing unit embodying the invention in a closed position.

FIG. 2 illustrates the cap 10 in a closed position 50 securely attached atop the air conditioning unit 58. The updraft fan 64 (not shown) is deactivated 70 thereby enabling the cap 10 to remain in a closed position 50. The cap member 12 further includes an upper 15 and lower periphery 17. The lower periphery 17 includes a fin 19 extending outwardly from the cap member 12 and along the lower periphery 17 until engaging shoulder member 22. Preferably the fin 19 extends outwardly from the lower periphery 17 of cap member 12 such that the fin 19 is substantially parallel to the top 59 of the unit 58 when the updraft fan 64 is deactivated 70. Fin 19 substantially avoids the generation of noise when the lower periphery 17 of cap 10 returns to the top 59 of unit 58 when the activated 68 updraft fan 64 is deactivated thereby causing the air pressure holding the cap 10 in the open position 48 to drop, allowing the cap 10 to fall to the closed position 50.

Figure 3:
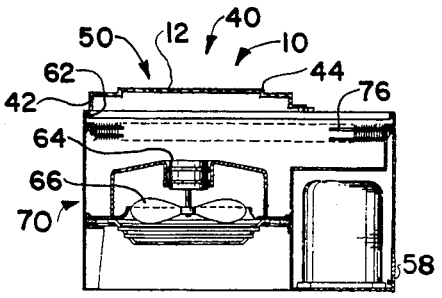
FIG. 3 is a sectional view taken along lines 3—3 of FIG. 2.

FIG. 3 is a sectional view taken along lines 3—3 of FIG. 2 illustrating the cap 10 in a closed position 50 and covering the exhaust opening 62 of the air conditioning unit 58 which houses the heat exchange coil (partial view) 76. Other configurations of the heat exchange coil 76 such as the type which wrap around the updraft fan 64 are within the scope of the invention. When the updraft fan 64 is deactivated the cap 10 closes because of the absence of a stream of air being forced against the cap 10. The step 44 of the cap member 12 enhances the closed position 50 of the cap 10 by decreasing the effect of wind lift on the cap member 12.

Figure 4:
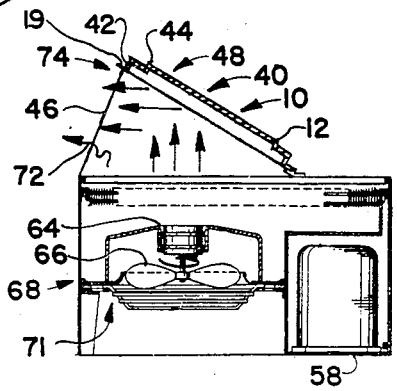
FIG. 4 is a sectional view taken along lines 4—4 of FIG. 1.

FIG. 4 is a sectional view taken along lines 4—4 of FIG. 1 illustrating the cap 10 in an open position 48 to enable the venting of the stream of heat exchanged air 72 produced by the activated updraft fan 64 and to enable the deflection of a portion of the sound 74 (as schematically illustrated) produced by the activated unit and/or updraft fan 64. The open position 48 occurs during the activation of the updraft fan 64 causing the rotation of the blades 66 of the updraft fan 64 moving ambient air 71 over the heat exchange coils 76 and expelling the heat exchanged ambient air 72 through the exhaust opening 62 formed in the air conditioning unit 58 and against the cap member 12. The cap member 12 further includes fin 19 positioned at the lower periphery 17 to enable the cap 10 to return to the closed position 50 upon deactivation 70 of the updraft fan 64 without hitting the top 59 of the unit 58 in a loud manner. The cap member 12 further includes a dome portion 40 positioned over the area of the exhaust opening 62 to provide a wind cup 42 to enhance the effect of the expelled heat exchanged ambient air 72 upon the cap member 12 when the updraft fan 64 is activated to enable the cap 12 to remain in a substantially stable open position 48. The dome 40 of the cap member 12 is preferably stepped 44 to decrease ambient wind lift on the cap member 12 thereby enabling the cap member 12 to remain in a substantially stable closed position 50 enhancing the prevention of debris and the like from entering the exhaust opening 62 when the updraft fan 64 is deactivated. The wind cup 42 acts as a sail to aid in retaining the cap 10 in a substantially stable open position 48 during activation of the updraft fan 64.

Figure 5:
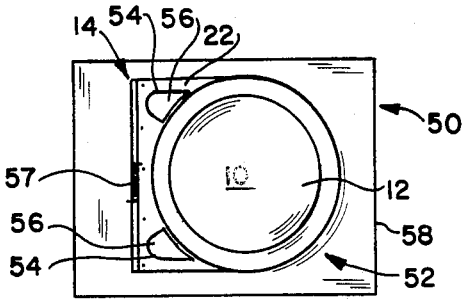
FIG. 5 is a top view of the cover of the invention.

FIG. 5 is a top plan view of the cap of the invention 10 in a closed position 50. The figure illustrates the shoulder member 22 and the reinforcing means 54 of the cap 10, such as a boss 56. The hinge member 14 is positioned along the shoulder member 22 which in turn is attached to the cap member 12. The reinforcing means 54 provides structural rigidity to the shoulder member 22 thereby limiting torquing or twisting of the cap member 12 during the activation of the updraft fan 64 and enhances the closure fit 52 of the cap 12 relative the exhaust opening 62 by limiting warping of the cap 12. A spring 57 enhances the closing of the cap 10 upon deactivation of the updraft fan 64.

Figure 6:
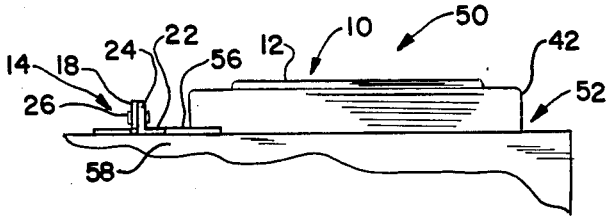
FIG. 6 is a partial sectional view illustrating an embodiment of the hinge member.

FIG. 6 is a fragmentary partial sectional view illustrating a further embodiment of the shoulder member 22. The flange 24 of shoulder member 22 enables the cap 10 to be easily removed from the air conditioning unit 58 by removing the connecting means 26 such as a plurality of nuts and bolts attachably securing the second side 18 of the hinge member 14 to the flange 24.

Figure 7:
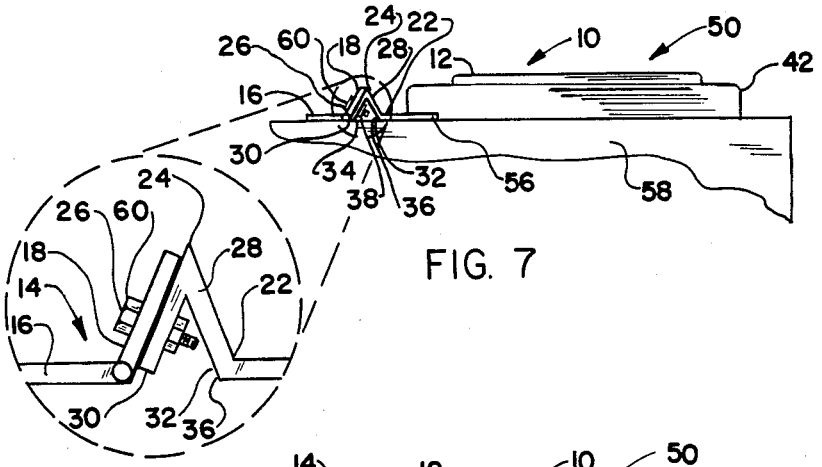
FIG. 7 is a partial sectional view illustrating a further embodiment of the hinge member.

FIG. 7 is a further embodiment of the flange 24 of shoulder member 22. The inverted V-shaped member 28 includes a first 30 and second 32 leg. The second side 18 of hinge member 14 is securably attached to the first leg 30 of the inverted U-shaped member 28 to enable the cap to be pivotally attached to the unit 58 by securing the first side 16 of hinge member 14 to the unit 58 proximate the exhaust opening 62 such that the enhance opening 62 is covered as shown in FIG. 1. The terminal portions 34, 36 of the first 30 and second 32 leg of the V-member, respectively, are spaced apart to provide the necessary space to receive the nut portion 38 of the bolt portion 60 of the connecting means 26. Preferably, V-shaped member 28 is integrally formed on the shoulder 22.

Figure 8:
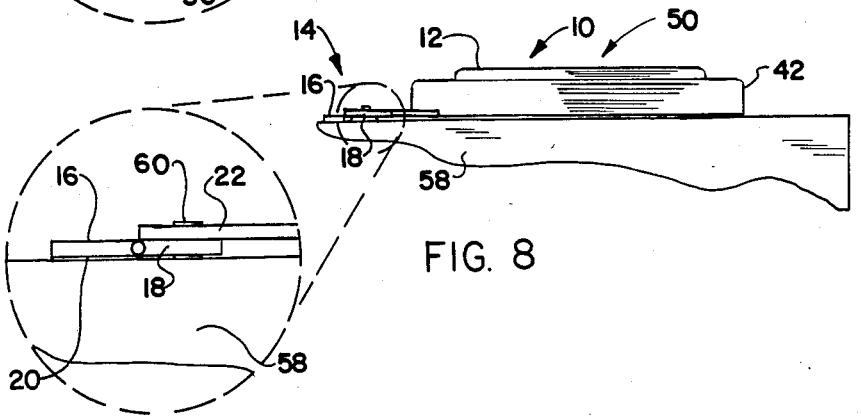
FIG. 8 is a partial sectional view illustrating a further embodiment of the hinge member.

FIG. 8 is a further embodiment of the shoulder member 22 with hinge member 14 having a first side 16 and second side 18. The shoulder member 22 enables a secure attachment of the cap member 12 to the second side 18 of the hinge member 14. The second side 18 of the hinge member 14 is securely attached to the shoulder member 22 by connecting means 60, such as a rivet,to enable the cap member 12 to pivot relative the first side 16 of the hinge member 18 to an open position 48 and a closed position 50. The first side 16 of the hinge member 14 further includes an adhesive coating 20 to adhesively secure the hinged 14 cap 12 to the air conditioning unit 58.

In air conditioner units where a top grill or grate covers a portion of the top of the unit greater than the exhaust opening, the portion of the grill not covered by the cap 10 which covers the exhaust opening 62, may be covered with a suitable fixed cover to insure that the advantages of the invention are obtained.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A cap for use with an air conditioning unit positioned in an environment having debris, rain, snow or sun and having heat exchange coils and an updraft fan with rotatable blades to enhance the heat exchange between ambient air and the heat exchange coils upon rotation of the blades moving the ambient air over the heat exchange coils and exiting said moving ambient air out an exhaust opening comprising:

a cap member;

a hinge member having a first side and a second side;

a shoulder member to enable secure attachment of said cap member to said second side of said hinge member;

said second side of said hinge member being securely attached to said shoulder member to enable said cap member to pivot relative to said first side of said hinge member; and said first side of said hinge member being securely attached to the air conditioning unit proximate said exhaust opening of the air conditioning unit to enable said cap member to pivot open upon rotation of the blades of the updraft fan moving ambient air out of the exhaust opening and to pivot to a closed position upon deactivation of the rotation of the blades of the updraft fan to thereby prevent the intrusion of the debris, rain, snow and sun into the exhaust opening of the air conditioning unit during the deactivation of the updraft fan and to deflect sound generated by the updraft fan during the activation of the updraft fan.

2. The cap member of claim 1 further including a dome portion positioned over the area of the exhaust opening to provide a wind cup thereby enhancing the effect of said air being forced against said cap member to enable said cap member to remain in a substantially stable open position when said updraft fan is activated.

3. The cap of claim 1 is biased in said closed position by a spring means upon deactivation of the updraft fan.

4. The cap of claim 1 further includes a flexible cord securely attached to said cap member and said air conditioner unit to limit the open angular position of said cap during the activation of said updraft fan.

5. The cap member of claim 1 further including an upper periphery and a lower periphery; and a fin extending outwardly from said cap member and along said lower periphery to enable said cap to fall in a gentle and substantially noiseless manner from said opend position to said closed position upon deactivation of said updraft fan.

6. A cap comprising:

a cap member;

an air conditioning unit located outdoors for conditioning the air in a dwelling said air conditioning unit having heat exchange coils;

said air conditioning unit further including an updraft fan with rotatable blades to enhance the heat exchange between ambient air and said heat exchange coils upon rotation of said blades during activation of said updraft fan thereby moving said ambient air over said heat exchange coils and expelling said heat exchanged ambient air through an exhaust opening formed in said air conditioning unit;

said cap member being configured to cover said exhaust opening of said air conditioning unit;

a hinge member having a first side and a second side;

a shoulder member to enable secure attachment of said cap member to said second side of said hinge member;

said second side of said hinge member being securely attached to said shoulder member to enable said cap member to pivot relative said first side of said hinge member; and said first side of said hinge member in use being securely attached to said air conditioning unit proximate said exhaust opening of said air conditioning unit to enable said cap member to cover said exhaust opening thereby preventing the intrusion of debris, snow, rain and sun into said exhaust opening of said air conditioning unit during the deactivation of said updraft fan and enabling said cap member to pivot relative to said first side of said hinge member to an open position upon rotation of said blades of said updraft fan thereby permitting the passage of heat exchanged air out of said exhaust opening and deflecting sound generated by said updraft fan away from said cap member during the activation of updraft fan.

7. The cap member of claim 6 further including a dome portion positioned over the area of the exhaust opening to provide a wind cup thereby enhancing the effect of said expelled heat exchanged ambient air upon said cap when said updraft fan is activated to enable said cap member to remain in a substantially stable open position.

8. The dome of claim 7 wherein the dome is stepped to decrease wind lift on said cap member thereby enabling said cap member to remain in a substantially stable closed position to enhance the prevention of debris and the like from entering the exhaust opening when said updraft fan is deactivated.

9. The cap of claim 6 wherein said cap member is biased in said closed position by a spring means upon deactivation of the updraft fan.

10. The cap of claim 6 wherein said first side of said hinge member further includes an adhesive coating to adhesively secure said cap member to said air conditioning unit.

11. The cap of claim 6 wherein said shoulder member further includes a flange for securing said second side of said hinge to said cap member.

12. The cap of claim 11 wherein said flange includes an inverted V-shaped member having a first and second leg;

said V-shaped member being integrally formed on said cap member; and said first leg being spaced apart from said second leg to enable a portion of a connection means securely attaching said second side of said hinge member to said first leg of said inverted V-shaped member to be spatially received between said first and second legs of said cap member.

13. The cap of claim 6 wherein said shoulder member further includes reinforcing means to enhance structural rigidity of said cap member thereby limiting torquing of said cap member during the activation of said updraft fan and enhancing the closure fit of said cap member relative said exhaust opening by limiting warping of said cap member.

14. The cap of claim 6 further includes a flexible cord securely attached to said cap member and said air conditioner unit to limit the open angular position of said cap during the activation of said updraft fan.

15. The cap member of claim 6 further including an upper periphery and a lower periphery; and a fin extending outwardly from said cap member and along said lower periphery to enable said cap to fall in a gentle and substantially noiseless manner from said open position to said closed position upon deactivation of said updraft fan.

16. A cap comprising:

a cap member;

an air conditioning unit located outdoors for conditioning the air in a dwelling;

said air conditioning unit including coils for exchanging heat with the ambient air;

said air conditioning unit further including an updraft fan with rotatable blades to enhance the heat exchange between the ambient air and said heat exchange coils upon rotation of said blades during activation of said updraft fan thereby moving the ambient air over said heat exchange coils and expelling said heat exchanged ambient air through an exhaust opening formed in said air conditioning unit;

said cap member being configured to cover said exhaust opening of said air conditioning unit;

a hinge member having a first and second side;

a shoulder member to enable secure attachment of said cap member to said second side of said hinge member;

said second side of said hinge member being securely attached to said shoulder member to enable said cap member to pivot relative said first side of said hinge member;

said shoulder member including a flange for securing said second side of said hinge to said cap member;

said flange further including an inverted V-shaped member having a first and second leg;

said first leg being spaced apart from said second leg to enable a portion of an connection means securely attaching said second side of said hinge member to said first leg of said inverted V-shaped member to be spatially received between said first and second legs of said V-shaped member;

said shoulder member further including reinforcing means to enhance structural rigidity of said cap member thereby limiting torquing of said cap member during the activation of said updraft fan and enhancing the closure fit of said cap member relative said exhaust opening by limiting warping of said cap member;

said cap member further including a dome portion positioned over the area of the exhaust opening to provide a wind cup thereby enhancing the effect of said expelled heat exchanged ambient air upon said cap member when said updraft fan is activated to enable said cap member to remain in a substantially stable open position;

said dome being stepped to decrease wind lift on said cap member thereby enabling said cap member to remain in a substantially stable closed position to enhance the prevention of debris and the like form entering the exhaust opening when said updraft fan is deactivated;

said cap member being biased in said closed position by a spring means upon deactivation of the updraft fan; and said first side of said hinge member in use being securely attached to said air conditioning unit proximate said exhaust opening of said air conditioning unit to enable said cap member to cover said exhaust opening thereby preventing the intrusion of debris, snow, rain and sun into said exhaust opening of said air conditioning unit during the deactivation of said updraft fan and enabling said cap member to pivot relative said first side of said hinge member to an open position upon rotation of said blades of said updraft fan thereby permitting the passage of heat exchanged air out of said exhaust opening and deflecting sound generated by said updraft fan away from said cap member during the activation of the updraft fan.

17. The cap of claim 16 wherein said first side of said hinge member further includes an adhesive coating to adhesively secure said cap member to said air conditioning unit.

18. The cap of claim 16 wherein said cap member further includes a flexible cord securely attached to said cap member and said air conditioner unit to limit the open angular postion of said cap member during the activation of said updraft fan.

19. The cap of claim 16 wherein said V-shaped member and said shoulder member are integrally formed on said cap member.

20. A method of preventing the intrusion of debris, rain, snow and sun into an exhaust opening of an updraft fan of an air conditioning unit during the deactivation of the updraft fan and to deflect sound generated by the updraft fan during the activation of the updraft fan comprising:

providing a cap member with a size sufficient to cover the exhaust opening of the air conditioning unit and including a hinge member having a first and second side with the second side of the hinge member being securely fastened to the cap member to enable the first side of the hinge member to pivot relative the second side of the hinge member; and conducting the prevention of the intrusion of debris, rain, snow and sun into the exhaust opening of an air conditioning unit during the deactivation of the updraft fan and to deflect sound generated by the updraft fan during the activation of the updraft fan comprising:

positioning the cap member on the air conditioning unit to cover the exhaust opening of the air conditioning unit;

attaching the first side of the hinge member to the air conditioning unit to enable the cap member to pivot open upon rotation of the blades of the updraft fan moving heat exchanged ambient air out of the exhaust opening and to deflect sound generated by the updraft fan and to pivot to a closed position upon deactivation of the rotation of the blades of the updraft fan to thereby cover and prevent the intrusion of debris, rain, snow and sun into the exhaust opening of the air conditioning unit during the deactivation of the updraft fan.

21. A cap comprising:

a cap member;

an air conditioning unit located outdoors for conditioning the air in a dwelling;

said air conditioning unit having heat exchange coils;

said air conditioning unit further including an updraft fan with rotatable blades to enhance the heat exchange between ambient air and said heat exchange coils upon rotation of said blades during activation of said updraft fan thereby moving said ambient air over said heat exchange coils and expelling said heat exchanged ambient air through an exhaust opening formed in said air conditioning unit;

said cap member being configured to cover said exhaust opening of said air conditioning unit;

a hinge member having a first side and a second side;

a shoulder member to enable secure attachment of said cap member to said second side of said hinge member;

said cap member further including a dome portion positioned over the area of the exhaust opening to provide a wind cup thereby enhancing the effect of said expelled heat exchanged ambient air upon said cap when said updraft fan is activated to enable said cap member to remain in a substantially stable open position;

said dome being stepped to decrease wind lift of said cap member thereby enabling said cap member to remain in a substantially stable closed position to enhance the prevention of debris and the like from entering the exhaust opening when said updraft fan is deactivated;

said second side of said hinge member being securely attached to said shoulder member to enable said cap member to pivot relative to said first side of said hinge member; and said first side of said hinge member in use being securely attached to said air conditioning unit proximate said exhaust opening of said air conditioning unit to enable said cap member to cover said exhaust opening thereby preventing the intrusion of debris, snow, rain and sun into said exhaust opening of said air conditioning unit during the deactivation of said updraft fan and enabling said cap member to pivot relative said first side of said hinge member to an open position upon rotation of said blades of said updraft fan thereby permitting the passage of heat exchanged air out of said exhaust opening and deflecting sound generated by said updraft fan away from said cap member during the activation of said updraft fan.

22. A cap for use with an air conditioning unit positioned in an environment having debris, rain, snow or sun and having heat exchange coils and an updraft fan with rotatable blades to enhance the heat exchange between an ambient air and the heat exchange coils upon rotation of the blades moving the ambient air over the heat exchange coils and exiting said moving ambient air out an exhaust opening comprising:

a cap member;

a hinge member having a first side and a second side;

a shoulder member to enable secure attachment of said cap member to said second side of said hinge member;

said cap member further including a dome portion positioned over the area of the exhaust opening to provide a wind cup thereby enhancing the effect of said air being forced against said cap member to enable said cap member to remain in a substantially stable open position when said updraft fan is activated;

said dome being stepped to decrease wind lift of said cap member thereby enabling said cap member to remain in a substantially stable closed position to enhance the prevention of debris and the like from entering the exhaust opening when said updraft fan is deactivated;

said second side of said hinge member being securely attached to said shoulder member to enable said cap member to pivot relative to said first side of said hinge member; and said first side of said hinge member being securely attached to the air conditioning unit proximate said exhaust opening of the air conditioning unit to enable said cap member to pivot open upon rotation of the blades of the updraft fan moving ambient air out of the exhaust opening and to pivot to a closed position upon deactivation of the rotation of the blades of the updraft fan to thereby prevent the intrusion of the debris, rain, snow and sun into an exhaust opening of the air conditioning unit during the deactivation of the updraft fan and to deflect sound generated by the updraft fan during the activation of the updraft fan.

* * * * *